US005512017A

United States Patent [19]

Gore et al.

[11] Patent Number: 5,512,017

[45] Date of Patent: Apr. 30, 1996

[54] PAINT SPRAY BOOTH AND SUPPLY PLENUM ARRANGEMENT

[75] Inventors: Anthony R. Gore, Farmington Hills; Phillip C. Cameron; David J. Cole, both of Canton, all of Mich.

[73] Assignee: Durr Industries, Inc., Plymouth, Mich.

[21] Appl. No.: 344,069

[22] Filed: Nov. 23, 1994

[51] Int. Cl.[6] ..... B05B 15/12

[52] U.S. Cl. ..... 454/52; 55/DIG. 46

[58] Field of Search ..... 454/50, 52; 118/326, 118/DIG. 7; 55/315, 341.2

[56] References Cited

U.S. PATENT DOCUMENTS

| | | | |
|---|---|---|---|
| 2,119,282 | 5/1938 | Ludwig . | |
| 3,625,133 | 12/1971 | Hayashi . | |
| 3,803,995 | 4/1974 | Allander . | |
| 3,935,803 | 2/1976 | Bush . | |
| 4,048,912 | 9/1977 | Walker . | |
| 4,131,059 | 12/1978 | Gustavsson . | |
| 4,537,120 | 8/1985 | Jusefsson | 454/52 |
| 4,932,316 | 6/1990 | Joefsson . | |
| 5,042,420 | 8/1991 | Gerdes | 454/52 X |
| 5,173,118 | 12/1992 | Joefsson | 118/309 |

FOREIGN PATENT DOCUMENTS

| | | | |
|---|---|---|---|
| 388996 | 9/1990 | European Pat. Off. | 454/52 |
| 62-266341 | 11/1987 | Japan . | |

*Primary Examiner*—Harold Joyce
*Attorney, Agent, or Firm*—Howard & Howard

[57] ABSTRACT

An air supply plenum for a paint spray booth includes a housing with separating walls positioned between the ceiling and a filter support panel of the plenum housing. The air flow supplied to the paint spray booth area is divided by the walls into three distinct flows: (1) a central flow air, through which the article to be painted travels in the paint spray booth, (2) two outer greater flow areas where the operators and/or equipment for applying paint to the article to be painted are located. Filters are positioned in the supply plenum arrangement adjacent and above the filter support panel separating the plenum and paint spray booth. The filters run longitudinally along the length of the plenum and between the separating walls. The positioning of these filters in this manner minimizes the amount of turbulence of the flow provided to the spray paint booth.

26 Claims, 4 Drawing Sheets

PAINT SPRAY BOOTH AND SUPPLY PLENUM ARRANGEMENT

BACKGROUND OF THE INVENTION

Paint spray booths are commonly found in production lines for vehicle bodies and parts. A vehicle body is transported through a paint spray booth where paint is applied to the body and subsequently dried. The paint may be applied by human operators or mechanically by automated equipment. During this painting process some of the paint may not be applied to the vehicle, but rather appears as overspray in the booth's atmosphere. This overspray must be removed from the paint spray booth to keep it from falling back on the painted vehicle or from being inhaled by the operators of the equipment.

The paint overspray is typically removed by providing an air flow from a supply plenum above the paint spray booth, through the paint spray booth and out to gas scrubber equipment which removes paint particles from the exhaust gas. It is desirable to maintain the air flow passing over the vehicle being painted turbulent-free. This ensures the air flow does not disturb the paint on the vehicle. The minimizing of the air flow about the vehicle increases the transfer efficiency onto the vehicle body. High air flow volumes in that location have a tendency to disrupt the transfer efficiency of the paint being applied onto the vehicle body. Moreover, by reducing the air flow at the central portion the overall volume of air is reduced. All of the air passing through the paint spray booth must be treated with a complicated process, and by reducing the air flow volume, the abatement requirements for cleaning the air are correspondingly reduced. At the same time however, it is also desirable to keep the air flow passing over the painting equipment operators at a higher velocity to prevent the operators from inhaling paint. Even with automated applicators, it is desirable to have the air flow velocity at the sides of the booth as high as possible to maximize the removal of the paint-laden air. The operator or automated applicator are typically in the paint spray booth alongside the vehicle to be painted.

Also in the prior art, roll filters in the plenum extended laterally across the width of the paint spray booth. Those roll filters were typically separated by upstanding frames extending above the height of the filter. The flames disrupted the flow of air from the supply plenum and into the paint spray booth, creating localized turbulent swirling portions in the air flow. As described above, the air flow in a paint spray booth is preferably kept as close to laminar as is possible. As such, the prior art supply plenums having frames disposed within the air flow and extending laterally across the paint spray booth had undesirable characteristics.

SUMMARY OF THE INVENTION

A major goal of this invention is to maintain a relatively low velocity, turbulent-free (preferably laminar) air flow through a portion of the paint spray booth through which the vehicle to be painted travels and maintain higher velocity flow rates through portions of the paint spray booth where operators of paint spray equipment are located. A novel air supply plenum for a paint spray booth is disclosed having a housing with separating walls extending between a ceiling and a middle panel of the housing. The panel termed the middle panel is a roll filter support panel. Side walls and the separating walls divide the air flow supplied to the paint spray booth area into at least three distinct flows: (1) a lesser velocity central flow, preferably as close to laminar as possible, through which the vehicle to be painted travels in the paint spray booth, (2) two greater velocity outer flow areas wherein the manual or automatic operators of equipment for applying paint to the article to be painted are located. An air supply means supplies a uniform flow of fresh air to the supply plenum, with the separating walls positioned to define three chambers which produce the three distinct air flows.

The roll filter is positioned adjacent and above the filter support panel, separating the plenum and the paint spray booth. The filter diffuses the air supplied by the air supply means. Preferably, a set of roll filters run longitudinally along the length of the plenum between the separating walls. The positioning of the filters in this manner minimizes the amount of turbulence in the flow provided to the spray paint booth when compared to the prior art. The separating walls do not create the turbulence problems that were created by the frames in prior art air flow. This is because the separating walls divide the flow, and are not positioned within the flow.

Bag filters are preferably associated with a intermediate panel located between the ceiling and filter support panels in the supply plenum. In this arrangement, the air flows through the individual bag filters down into the chambers defined between the housing side walls and separating panels and into the paint spray booth in three distinct flow patterns as described above.

In one embodiment, the distinct air flows are achieved by making the central chamber, associated with the space above the vehicle, of a flow area approximately twice that of either of the side chambers. The bag filters control the air flow leading into each of the chambers. The bag filters each provide some resistance to flow, and in one preferred embodiment, the bag filters for each of the three chambers are selected to be approximately of the same resistance. In that way the volume of air flow leading into each of the three chambers is approximately equal. However, since the flow area of the chamber associated with the space above the vehicle is of much greater area, the air flow velocity leading out of that chamber and into the space above the vehicle will be much less than the velocity at either of the outer positions. Alternatively, other ways of achieving the distinct air flows may come within the scope of this invention.

In combination with the longitudinal arrangement of the roll filters, the ends of the plenum are provided with a space frame arrangement that provides sufficient lateral structural rigidity such that the prior art laterally extending frames can be eliminated. The present invention allows the longitudinally extending roll filter frame to extend to lengths on the order of 30 feet without the requirement of additional structural support. The elimination of the additional required supports further eliminates additional obstructions to flow, decreasing the turbulence in the flow. As described above, this is a major goal for an air plenum associated with a paint spray booth.

These and other features of the present invention will be best understood from the following specification and drawings, of which the following is a brief description.

DETAILED DESCRIPTION OF THE INVENTION

Figure 1:
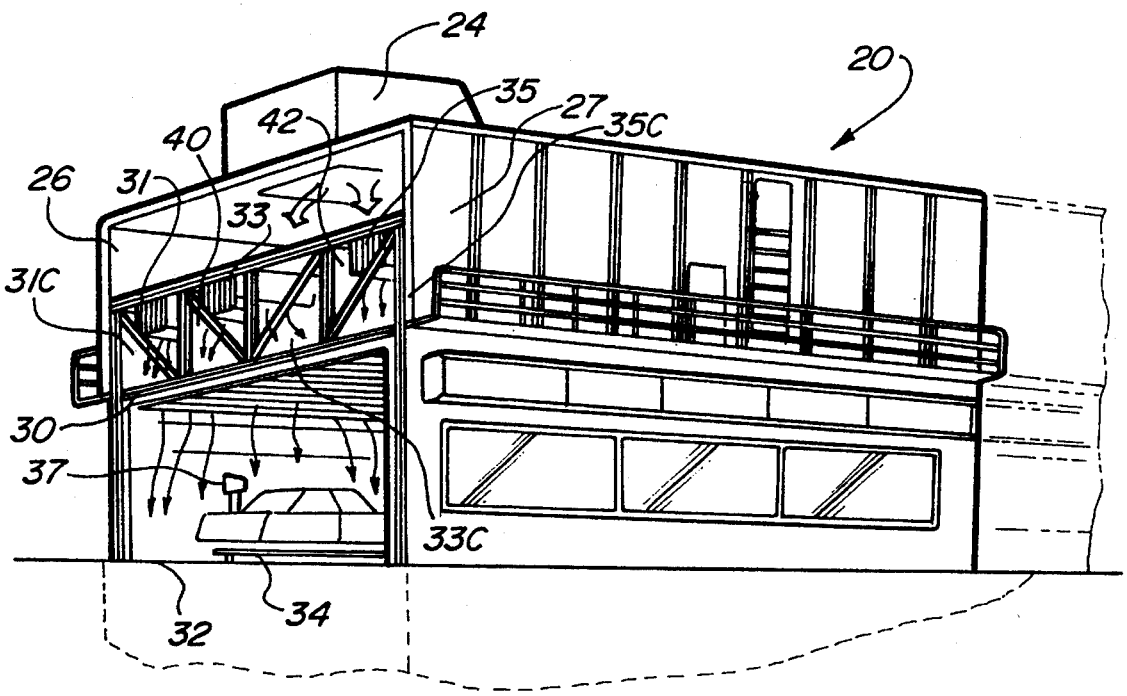
FIG. 1 is a perspective view of a paint spray booth and supply plenum in accordance with the invention herein.

FIG. 1 shows a paint spray booth and supply plenum arrangement 20 having inner separating wails in accordance with the invention as will be described below. The supply plenum arrangement has a housing with opposed longitudinally extending side walls 26 and 27, a ceiling panel 28, and a filter support panel 30. The paint spray booth has a floor panel 32. The arrangement and housing are primarily divided into two principal areas: a supply plenum area and a paint spray booth area. Side walls 26 and 27, ceiling panel 28, and a filter support 30, make up the four sides of the supply plenum area.

The ceiling panel 28 receives an air supply 24 which provides air flow to the plenum area through an inlet air duct which may include a fan and damper assembly for controlling the main flow of air into the booth. Supply 24 can be any apparatus that can provide a supply of relatively clean, dust free air to the arrangement herein. Blowers and fans of the type required herein are well known in the art.

Figure 2:
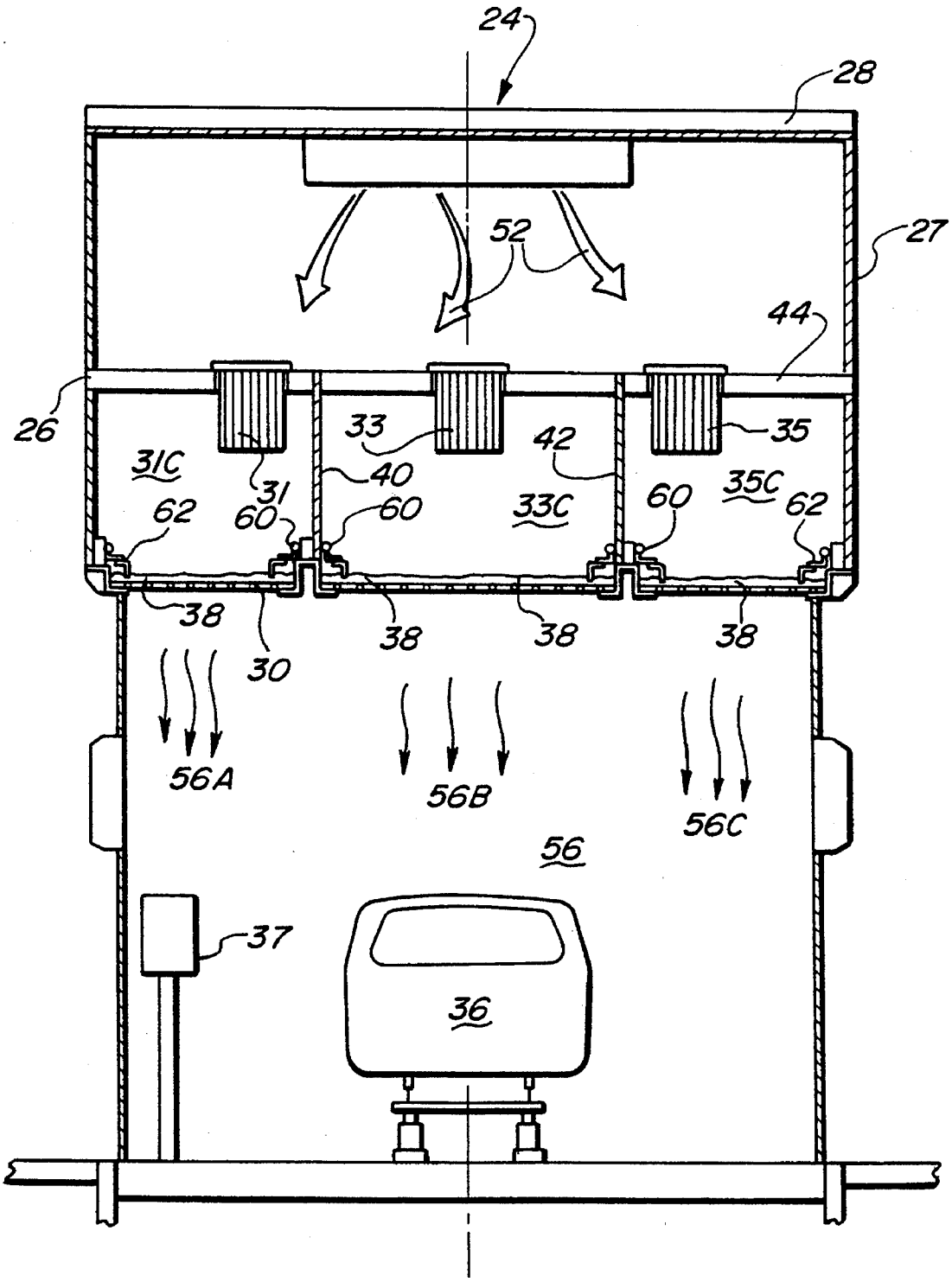
FIG. 2 is an end view of the spray booth shown in FIG. 1.

As shown in FIG. 2, the inlet air passes through a plurality of bag-type air filters 31, 33 and 35. After passing through the bag-type filters, air supplied to the plenum travels into one of chambers 31*c*, 33*c* or 35*c*, and communicates with a roll filter 38 prior to passing through filter support 30 and into the paint spray booth. The filter material is preferably of known type and may comprise a blanket of synthetic media diffusion filter.

Within the plenum area, and spaced between opposed side walls 26 and 27, separating walls 40 and 42 extend between an intermediate 44 and falter support 30 to define lateral walls of chambers 31*c*, 33*c* and 35*c*. The separating walls 40 and 42 are positioned substantially parallel to the opposed side walls 26 and 27. As will be described, the velocity of air leaving chamber 33*c*, between separating walls 40 and 42 is substantially lower them the velocity of air leaving chambers 31*c* or 35*c* between either separating wall and the side walls. Since the flow rate of the air provided to the plenum is substantially uniform along a cross section of the supply plenum, the distinct flow rates through the chambers between the individual walls can be regulated by positioning the separating walls in a particular manner. Preferably, the flow velocity through chamber 33*c* between the separating walls is significantly lowered relative to the air flow velocity through chambers 31*c* and 35*c* between either separating wall and a side wall. One way of achieving the distinct air flow is by positioning the separating walls in such a manner that chamber 33*c* between the separating walls has a proportionally greater flow area than chambers 31*c* or 35*c* between a separating wall and a side wall, while maintaining relatively equal volume air flow into all of the chambers. The bag filters 31, 33, and 35 provide a resistance to air entry. By controlling the respective resistances, the volume of air leading into each chamber 31*c*, 33*c* and 35*c* can be controlled. With equal volumes of air, the larger flow area chamber 33*c* will result in a lower exit velocity compared to the same flow through a smaller area in chambers 31*c* and 35*c*.

While only three chambers are illustrated in the drawings of this Application, it should be understood that greater numbers of air flow zones could be built incorporating this invention, as could lesser numbers. As an example, with additional separating walls, more than three distinct air flow zones could be developed within the paint spray booth. Alternatively, the invention could extend to a plenum defining only two air flow zones. Further, the structure of the plenum and its roll falter longitudinal arrangement, which will be described in greater detail below, has benefits in the prior art plenums that have a single air flow zone across the width of the plenum.

While the roll filters 38 are described as the diffusing element in this Application, it should be understood that other types of air diffusers could be incorporated into this invention. Plates and other such structures are known, and would also be adaptable to the inventive separating wall features of this invention.

A vehicle to be painted 36 is shown mounted on a conveyor 34 which moves a series of such vehicles longitudinally through the length of the paint spray booth above the floor panel 32. The floor panel typically is a grated floor which allows air to flow to a gas scrubber assembly where the air is treated to remove paint particles before the air is recycled or exhausted. Because of the inventive air plenum, the volume of air which must be treated is significantly reduced, as the required volume of air for the central portion has been reduced. In addition, the efficiency of transfer of the paint to the vehicle is also increased due to the reduced air volume at a central portion of the paint spray booth. Conveyor 34 preferably runs along a central corridor the length of the spray paint booth at a lateral center between the opposed side walls 26 and 27. On either side of this corridor, paint spray devices (such as gun 37, shown schematically) are positioned which allow human operators or automated equipment to apply paint in spray form onto the vehicle. The flow of air in the space where the vehicle travels is preferably maintained as close to turbulence-free or laminar as possible, such that the application of paint is not disturbed. Turbulence in this space may disturb the paint finish on the vehicle. On the other hand, it is desirable to supply a vigorous flow of air in the spaces where the spray painting equipment is located. Regardless of the design of the spray paint booth, some paint exists in the paint spray booth as overspray which should be removed from the paint spray booth as quickly and efficiently as possible. Separating walls 40 and 42 in the supply plenum above the spray paint booth provide a relatively low velocity, preferably laminar flow rate of air to the space through which the conveyor and vehicle to be painted travel. A higher velocity flow rate is provided to the space where spray paint equipment is located in the spray paint booth, typically on either side of the space through which the conveyor and vehicle travel, adjacent the side walls.

As shown in FIG. 2, a uniform flow of air is supplied to the supply plenum area 52. The air travels through bag filters 31, 33 and 35 into one of chambers 31*c*, 33*c*, and 35*c*, passes through roll filter material 38 and filter support 30 and into the paint spray booth area 56 in three distinct flows: 56*a*, 56*b* and 56*c*. The separating walls 40 and 42, are positioned to control the flow velocity rate through the supply plenum into paint spray booth areas 56*a*, 56*b* and 56*c*. The flow velocity into paint spray booth area 56*b* above vehicle 36 is much lower than the flow rate of air into areas 56*a* and 56*c*, and is preferably maintained such that the flow is as close to laminar as is possible. Bag filters 31, 33 and 35 are supported by intermediate panel 44 which is connected to opposing side walls 26 and 27, ceiling panel 28 and filter support 30 above separating walls 40 and 42.

The bag filters 31, 33 and 35 provide resistance to air flow reaching the respective chambers 31*c*, 33*c* and 35*c*. By controlling these resistances, one can control the volume of air reaching any one of chambers 31*c*, 33*c* and 35*c*, relative to the other two. The invention utilizes this control to achieve distinct flow velocity rates in areas 56*a*, 56*b* and 56*c*. As one example, the separating walls 40 and 42 are shown separated by a distance which is approximately half of the total distance between the two side walls 26 and 27. In this way, the flow area of chamber 33*c* is approximately twice that of either chambers 31*c* or 35*c*. The bag filters 31, 33 and 35 are preferably controlled such that the volume of air reaching the chambers 31*c*, 33*c* and 35*c* is approximately equal. Since the flow area of chamber 33*c* is twice that of chambers 31*c* or 35*c* and the air volumes are equal, the velocity of the air leaving that central chamber 33*c* is approximately one-half the velocity of the air leaving chambers 31*c* or 35*c*. Various other methods could be utilized to achieve these distinct flow velocities.

It should be understood, the invention would also extend to numbers of flow zones other than three. In addition, this invention extends to inventive features relating to the mounting of the roll filter material 38. Those inventive features would extend to plenums defining only a single zone.

As also shown in FIG. 2, the roll filters 38 are held in place by a plurality of hold down rail members 60 at separating walls 40 and 42, and intermediate hold down members 62 at other locations. As shown, there are two rolls 38 associated with the central chamber 33*c*, and a single roll at each outer chamber. The rolls each extend longitudinally into the plane of FIG. 2. The hold down members 60 and 62 are pivoted to hold the roll filter material 38. In addition, the shape of the hold down member is selected to minimize the creation of turbulence. In the past, the lateral struts have had an I-beam construction that has provided even greater resistance to air flow, creating more turbulence.

Figure 3:
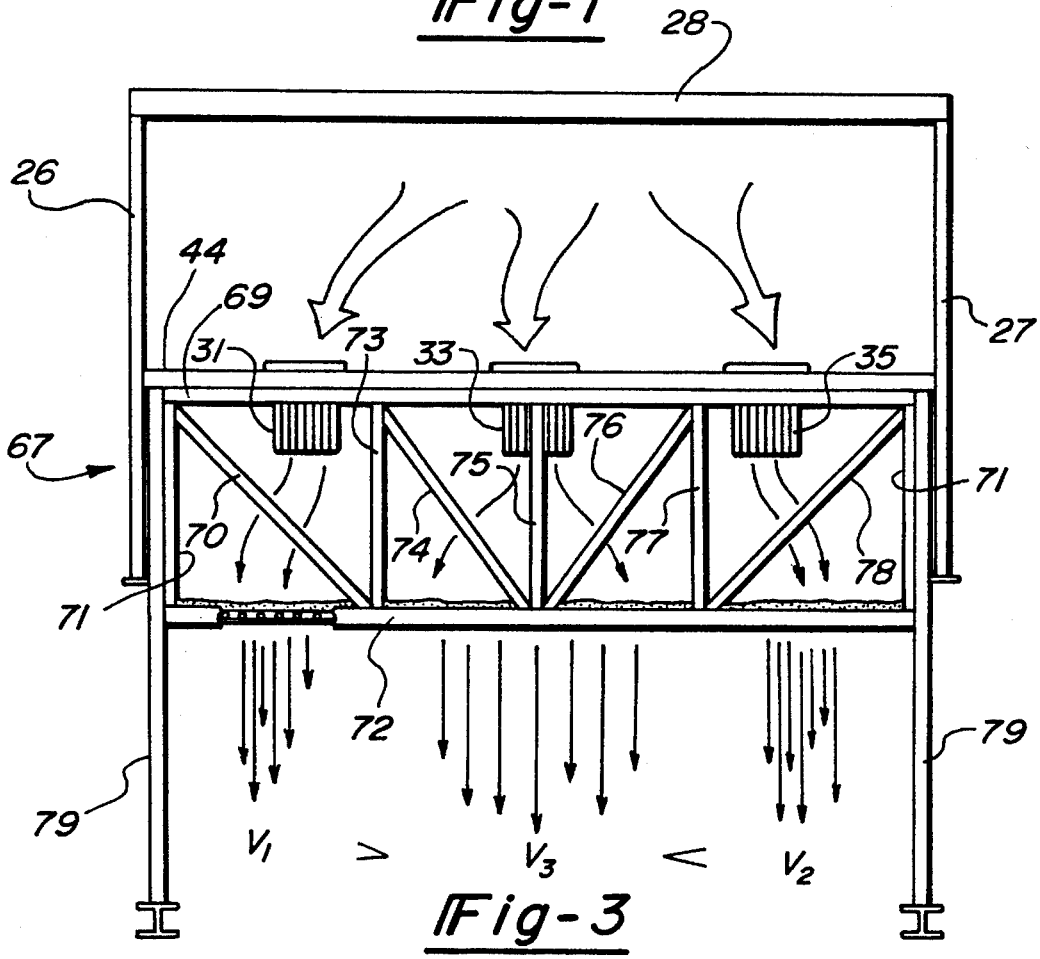
FIG. 3 is a sectional view of the supply plenum portion of the invention shown in FIG. 1.

As shown in FIG. 3, a unique space frame mounting construction 67 provides lateral structural stability to the overall plenum 20. As shown, space frame construction 67 includes a top frame 69 and a first strut 70 extending between side strut 71 and a bottom frame 72. Struts 73, 75 and 77 extend vertically between bottom frame 72 and top frame 69. Struts 74 and 76 extend at an angle from struts 73, 75 and 77, as shown. A strut 78 extends from strut 77 to side strut 71. Side frame post 79 extends vertically upwardly from the paint spray booth at the longitudinal ends of the paint spray booth.

The side frame posts 79 are welded as shown in FIG. 3 to the top frame 69, the bottom frame 72 and to the side struts 71. The side frame posts 79 are also connected to the intermediate panel 44 and within the side walls 26 and 27. The connection of all of these members together provides sufficient lateral support such that the overall plenum can eliminate the prior art lateral supports. It should be understood that the space frame 67 is preferably at the longitudinal ends of the plenum. The space frame construction 67 provides sufficient lateral support such that the inclusion of the spaced frame construction at each longitudinal end of the plenum allows the plenum to extend for distances on the order of 30 feet without further bracing. This allows the elimination of the prior art lateral supports. Thus, the amount of frame material within the plenum is greatly reduced over the prior art, in turn reducing the turbulence created in the flow by the prior art frame members.

Figure 4:
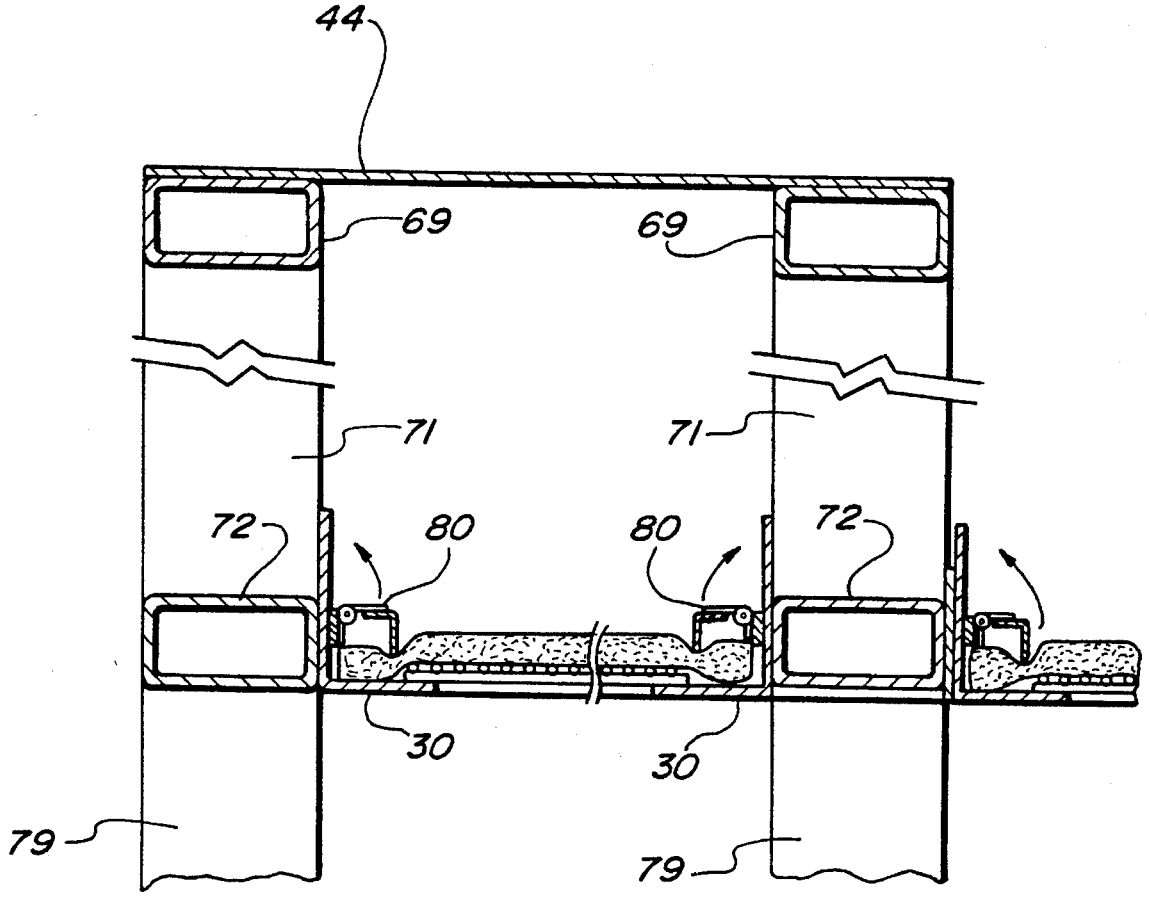
FIG. 4 is a cross-sectional view of the ends of the plenum.

Placing side frame posts 79 within side walls 26 and 27 significantly increases the structural rigidity of plenum 20. The side frame posts 79 also tie the structural rigidity of the plenum into the rigidity of the paint spray booth. As shown in FIG. 4, the side struts 71 extend between the top frame 69 and bottom frame 72. The intermediate panel 44 is connected directly above the top frame 69. In addition, end hold down members 80 are positioned at each end of the plenum, and include pivoting hold down members.

Figure 5:
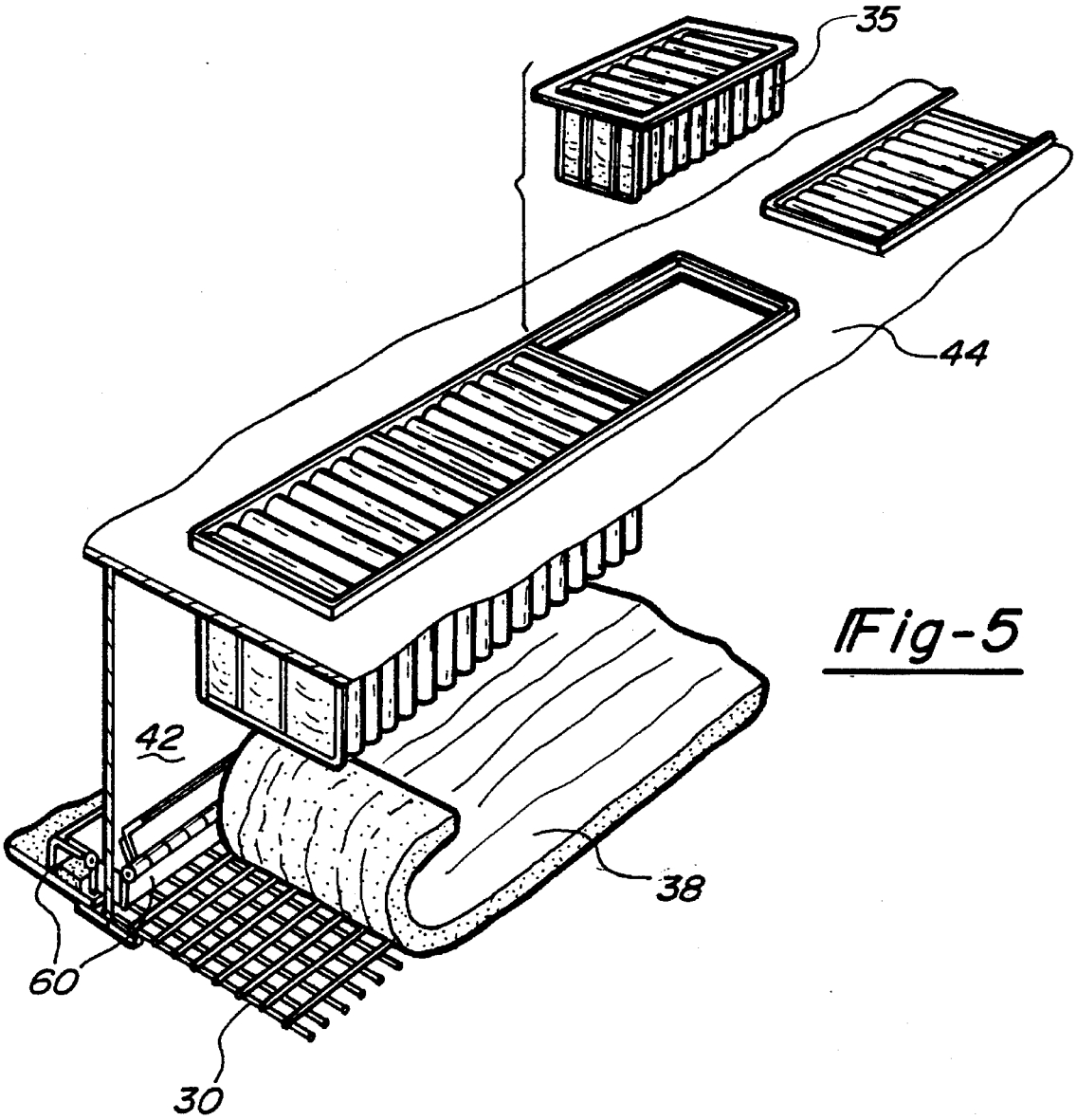
FIG. 5 is a perspective, partial view of a preferred embodiment of the invention showing details of an inventive filtering means.

In FIG. 5, a preferred embodiment is depicted showing filter roll 38 overlaying the filter panel 30. As noted above, turbulence in the air flow supplied to the paint spray booth area is detrimental to the paint on the vehicle. The invention minimizes turbulence in the air flow passing through the filter and filter support panel and into the paint spray booth by arranging filter rolls overlaying the filter support panel and extending longitudinally along the length of the supply plenum area. In the past, the filters extend laterally across the filter support panel. Separating frames also extended laterally, creating an increased amount of turbulence in the paint spray booth area.

In the past, the frames separating the laterally extending filters extended upwardly into the flow, thus creating localized swirls. The inventive separating walls 40 and 42 divide the air flow, and are not located within the air flow. As such, they do not contribute significant turbulence as was contributed by the prior art frames. The longitudinally extending filters, and the elimination of the lateral supports is possible due to the space frame construction.

Also in FIG. 5, bag filter 33 is seen supported by intermediate panel 44 above filter support 30 and filter 38. As discussed above, these bag filters eliminate impurities which may accompany the air supplied to the supply plenum by the air supply means 24. Filter support panel 30 also is shown to include a steel mesh to support roll filter 38.

As discussed above, the structure 60 and 62 holding the roll filters in their position have been specifically designed to minimize the amount of turbulence created in the flow. The overall inventive plenum maximizes the free and clear roll filter media area by minimizing obstructions to the air flow. As such, the arrangement of the filter media provides important benefits over the prior art.

A preferred embodiment of this invention has been disclosed, however, a worker of ordinary skill in the art would recognize that certain modifications would come within the scope of this invention. For that reason, the following claims should be studied in order to determine the true scope and content of this invention.

We claim:

1. A paint spray booth and supply plenum arrangement comprising:

a) an air supply means for supplying air flow to a supply plenum;

b) a plenum housing extending along a longitudinal direction and having opposed side walls spaced by a lateral direction, an upper panel and a support panel defining the bottom of said plenum;

c) spaced opposed separating walls positioned within said housing extending parallel to said side walls and at locations between said upper panel and said support panel such that said separating walls divide the air flow which travels through the plenum into at least three distinct flows:

(1) a first flow between a first of said side walls and a first of said separating walls;

(2) a second flow between a second of said side walls and a second of said separating walls; and (3) a third flow between said first separating wall and said second separating wall;

said flows extending into a paint spray booth defined beneath said support panel, and an air supply system and flow control such that said first and second flows are of a velocity that is substantially greater than the velocity of the third flow;

d) a conveyor received in said paint spray booth for transporting a vehicle through the longitudinal length of said paint spray booth, said conveyor being received at a lateral position aligned with said third flow, below and between the separating walls; and e) means for applying paint to a vehicle, said means for applying paint positioned at a lateral position substantially aligned with one of said first and second flows in said paint spray booth.

2. The arrangement of claim 1, wherein said separating walls are spaced from said side walls by a distance selected such that the ratio of the distance between said separating walls and said walls, to the ratio of the distance between said separating walls would be inversely proportional to a desired ratio of the velocity of said first or second air flow to said third air flow.

3. The arrangement of claim 1, wherein said separating walls are positioned such that the ratio of the distance between said separating walls to the distance between said separating wall and one of said side walls is about 2:1 such that the velocity of said first and second flows is twice said third flow.

4. The arrangement of claim 1, wherein said third flow is substantially laminar.

5. The arrangement of claim 1, wherein a set of roll filters run longitudinally, are supported on said support panel, and are separated into three sections by said separating walls.

6. The arrangement of claim 1, wherein said upper panel is an intermediate panel, there being a ceiling panel spaced upwardly of said intermediate panel.

7. The arrangement as recited in claim 6, further comprising multiple bag filters associated with said intermediate panel between said ceiling panel and said support panel, said separating walls extending from said support panel to said intermediate panel.

8. The arrangement of claim 7, wherein said bag filters provide a resistance controlling the amount of air flow moving into each of three separate chambers associated with said plenum, said three chambers being associated with said first, second and third air flows.

9. The arrangement as recited in claim 8, wherein the resistance provided by said bag filters into each of said three chambers is roughly equivalent, and the distinct air flows of said first, second and third air flows are achieved by controlling the flow areas of said first, second and third chambers.

10. A supply plenum arrangement for a vehicle paint spray booth comprising:

a) an air supply means for supplying a fresh air flow to the supply plenum;

b) a plenum housing having opposed side walls extending longitudinally, and spaced by a lateral dimension, a ceiling panel associated with said air supply means and a support panel defining the bottom of said plenum, an intermediate panel extending between said side walls and located intermediate said ceiling and said support panels;

c) at least one separating wall positioned within said housing and extending between said intermediate and support panels wherein said separating wall is essentially perpendicular to said support panel such that said separating wall divides the plenum into at least two chambers, a common plenum for each of said chambers being formed above said intermediate panel and below said ceiling panel and the air flow which passes through said intermediate panel and into said chambers being divided into distinct flows:

(1) a first flow from a first chamber between a first of said side walls and one of said at least one separating wall; and (2) a second flow from a second chamber between a second of said side walls and one of said at least one separating wall.

11. The arrangement as recited in claim 10, wherein there are at least two of said separating walls defining three distinct air flows.

12. The arrangement as recited in claim 11, wherein the distance between said first and second separating walls is approximately equal to one-half the total distance between said side walls such that three distinct chambers are defined, with said three chambers being associated with first, second and third air flows, respectively, and a third chamber defined between first and second separating walls is larger than first and second chambers associated with said first and second air flows, such that said distinct velocities between said first and second air flows and said third air flow are achieved.

13. The arrangement of claim 11, wherein said separating walls are spaced from said side walls by a distance selected such that the ratio of the distance between said separating walls and said side walls, to the ratio of the distance between said separating walls would be inversely proportional to a desired ratio of the velocity of said first or second air flow to said third air flow.

14. The arrangement of claim 13, wherein said separating walls are positioned such that the ratio of the distance between said separating walls to the distance between said separating wall and one of said side walls is about 2:1.

15. The arrangement of claim 10, wherein a set of roll filters run longitudinally, and supported on said support panel, and are separated into three sections by said separating walls.

16. The arrangement of claim 15, wherein longitudinally extending hold down members hold said roll filter on said support panel.

17. The arrangement of claim 16, wherein space frame arrangements are disposed at each longitudinal end of said plenum to provide lateral structural support to said plenum, said space frame including struts associated with each of said chambers extending from an upper end adjacent one of said sidewalls and one of said at least one separating wall and lower end adjacent the other of said walls.

18. The arrangement of claim 17, wherein said struts are attached to separate frame members positioned adjacent said sidewalls and said separating wall.

19. The arrangement of claim 10, wherein filters are mounted in said intermediate panel to provide a resistance controlling the amount of air flow moving into each of said chambers and the resistance provided by said filters into each of said chambers is roughly equivalent, and the distinct air flows of said first and second air flow are achieved by controlling the flow areas of said first and second chambers.

20. A paint spray booth and supply plenum arrangement comprising:

a) air supply means for supplying air flow to a supply plenum;

b) a plenum housing extending along a longitudinal direction and having opposed side walls spaced by a lateral direction, said longitudinal direction being longer than said lateral dimension a ceiling panel and a support panel defining the bottom of said plenum;

c) roll filter means for diffusing the air flow, said filter means being positioned above and adjacent said support panel, said filter means being formed from filter material extending longitudinally parallel to said side wall; and d) a conveyor position beneath said roll filter and in said paint spray booth, said conveyor transporting a vehicle along the longitudinal length of said arrangement, and stabilizing structures at each longitudinal end of said booth to provide lateral structural stability.

21. A paint spray booth as recited in claim 20, wherein separating walls are defined at two lateral positions between said side walls, said separating walls also extending parallel to said side walls and to said filter material.

22. A paint spray booth as recited in claim 21, wherein longitudinally extending hold down members hold said roll filter on said support means.

23. A paint spray booth as recited in claim 20, wherein space frame arrangements are disposed at each longitudinal end of said plenum to provide lateral structural support to said plenum, said space frames including struts extending from an upper end adjacent one panel of said housing and a lower end adjacent another panel of said housing.

24. A paint spray booth, as recited in claim 23, wherein said space frame includes a top frame and a bottom frame at each longitudinal end of said plenum, said top frame and said bottom frame being connected to side struts at each longitudinal end, said side frame members being connected to said side walls of said plenum, and said struts extending between said top frame and said bottom frame.

25. A paint spray booth, as recited in claim 24, wherein said struts include at least three struts extending at an angle, with one of said struts having one end connected to one of said side struts and a second end connected to said bottom frame, another of said struts having one end connected to a vertically extending strut and a second end connected to said bottom frame and a third of said struts having one end connected to a vertically extending strut and a second end connected to one of said side struts.

26. A paint spray booth, as recited in claim 25, wherein side frame members extend upwardly from said paint spray booth and said top and bottom frame members are connected to said side frame members.

* * * * *